US010939513B2

(12) United States Patent
Ha et al.

(10) Patent No.: US 10,939,513 B2
(45) Date of Patent: Mar. 2, 2021

(54) STRUCTURE FOR SHIELDING ELECTROMAGNETIC WAVES, DOOR AND COOKING APPLIANCE THEREWITH

(71) Applicant: LG ELECTRONICS INC., Seoul (KR)

(72) Inventors: Jung Hyeong Ha, Seoul (KR); Dong Hun Kim, Seoul (KR); Sung-Hun Sim, Seoul (KR); Kyoungsam Yim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 274 days.

(21) Appl. No.: 16/023,094

(22) Filed: Jun. 29, 2018

(65) Prior Publication Data

US 2019/0021145 A1 Jan. 17, 2019

(30) Foreign Application Priority Data

Jul. 12, 2017 (KR) ..... 10-2017-0088620

(51) Int. Cl.
*H05B 6/76* (2006.01)

(52) U.S. Cl.
CPC ..... *H05B 6/763* (2013.01); *H05B 6/766* (2013.01)

(58) Field of Classification Search
CPC ..... H05B 6/763; H05B 6/766; H05B 6/6414
See application file for complete search history.

(56) References Cited

U.S. PATENT DOCUMENTS 5,705,797 A * 1/1998 Seo ..... H05B 6/763 219/742
2003/0141298 A1* 7/2003 Lee ..... H05B 6/763 219/741
2005/0072777 A1* 4/2005 Kim ..... H05B 6/763 219/741

FOREIGN PATENT DOCUMENTS

KR 1020020022954 A 3/2002
KR 1020030012638 A 2/2003
KR 1020050005020 A 1/2005

* cited by examiner

*Primary Examiner* — Ibrahime A Abraham
*Assistant Examiner* — Dilnessa B Belay
(74) *Attorney, Agent, or Firm* — Dentons US LLP

(57) ABSTRACT

Disclosed herein are a structure for shielding electromagnetic waves, a door and a cooking appliance having the same. The structure for shielding electromagnetic waves includes a choke seal structure having a bottom face extended from a side wall portion formed at a periphery of a door in a plane direction defined by the door, an inner side face extended from the bottom face in a thickness direction of the door, and a top face extended from the inner side face toward side wall portion, the choke seal structure having a length extending along the periphery of the door, a plurality of slots arranged in a longitudinal direction of the choke seal structure at a predetermined spacing and partitioning the choke seal structure into a plurality of chokes, and a connecting face connecting between the top faces of some of the plurality of chokes, each of which has a latch hole formed in its inner side face.

16 Claims, 6 Drawing Sheets

STRUCTURE FOR SHIELDING ELECTROMAGNETIC WAVES, DOOR AND COOKING APPLIANCE THEREWITH

CROSS-REFERENCE TO RELATED APPLICATIONS

This application claims the priority of Korean Patent Application No. 10-2017-0088620 filed on Jul. 12, 2017, in the Korean Intellectual Property Office, the disclosure of which is hereby incorporated by reference in its entirety.

BACKGROUND

1. Technical Field

The present disclosure relates to a structure for shielding electromagnetic waves, a door and a cooking appliance therewith. More specifically, the present disclosure relates to a structure for shielding electromagnetic waves to block leakage of electromagnetic waves, a door and a cooking appliance therewith.

2. Description of the Related Art

A cooking appliance is a kind of household appliances for cooking food, which is installed in a kitchen and is used to cook food people want. Such cooking appliances may be classified by the heat source, shape or the type of fuel.

Cooking appliances may be classified into open-type cooking appliances and closed-type cooking appliances depending on where food is placed and how to cook it. The closed-type cooking appliances include an oven, a microwave oven and the like, while open-type cooking appliances include a cooktop, a hob and the like.

A closed-type cooking appliance has a closed space where food is placed, and the food is cooked by heating the closed space. A closed-type cooking appliance includes therein a chamber in which food is placed and which is closed during cooking. In the chamber, food is actually cooked. A heat source is disposed inside or outside the chamber to heat it.

Among closed-type cooking appliances, a microwave oven heats food by generating microwaves by using electricity to pass them into food accommodated in a cooking chamber, and inducing molecular motion therein.

The microwave oven is a kitchen appliance that irradiates high frequency waves of a magnetron onto food to be cooked to heat the inside and the outside of the food simultaneously. It has the advantages that the heat efficiency is high and thus the cooking time is drastically shortened, that the loss of nutrition is reduced in the process of cooking, defrosting and warming of food, and that food can be cooked as it is in the container. Therefore, microwave ovens are widely used because of these advantages.

Typically, such a microwave oven includes a door for opening and closing a cooking chamber formed inside the main body. Types of the doors for microwave ovens may include a hinged door, an upper-and-over door and a sliding door according to the mechanisms. Among these, the hinged door is most commonly used.

Between the main body and the door, a latch is disposed for fixing the door for opening or closing the cooking chamber.

The latch serves as a hook to keep the door closed, and also senses whether the door is closed and prohibits cooking if the door is open.

A door seal is formed along the periphery of the rear face of the door facing the cooking chamber, which comes in tight contact with the front face of the main body. A choke is disposed on the outer periphery of the door seal, which is a structure for shielding electromagnetic waves for preventing the electromagnetic waves in the cooking chamber from leaking through the gap between the cooking chamber and the door.

The choke includes a plurality of choke slits arranged along the periphery of the door. Each of the choke slits has a connecting portion extending from the periphery the door toward the cooking chamber, and a bending portion bent at the end of the connecting portion and extending toward the door seal.

The choke thus formed forms a circuit for shielding electromagnetic waves LC together with the front face of the main body facing the door. In order to form the circuit of excellent performance, it is typically desired to design the choke so that the choke slits have a periodic structure.

Incidentally, in order to install the latch in the door, a mounting hole has be formed so that a part of the latch installed in the door, i.e., a holding part to be engaged with the front face of the main body passes through.

Since both the latch and the choke have to be disposed in the area facing the front face of the main body, the mounting hole may be formed in the region where the choke is formed or in the region very close to the choke.

When this happens, as the size of the mounting hole increases, it is more likely that the electromagnetic waves leak through the mounting hole, and the shape of the choke slits may become uniform at the position where the mounting hole is formed. As a result, the periodic structure of the choke is broken, and thus the performance for shielding electromagnetic waves of the choke may be deteriorated.

In order to overcome this issue, it may be contemplated to reduce the size of the mounting hole. Unfortunately, it is difficult and takes more time to reduce the size the mounting hole, such that the productivity of the cooking appliance is lowered.

SUMMARY

It is an object of the present disclosure to provide an improved structure for shielding electromagnetic waves capable of providing a stable performance even with a hole for mounting a latch, a door and a cooking appliance having the structure.

It is another object of the present disclosure to provide a stable electromagnetic wave shielding performance without increasing difficulty and time required for mounting a latch.

In accordance with one aspect of the present disclosure, a structure for shielding electromagnetic waves includes: a choke seal structure having a bottom face extended from a side wall portion formed at a periphery of a door in a plane direction defined by the door, an inner side face extended from the bottom face in a thickness direction of the door, and a top face extended from the inner side face toward side wall portion, the choke seal structure having a length extending along the periphery of the door; a plurality of slots arranged in a longitudinal direction of the choke seal structure at a predetermined spacing and partitioning the choke seal structure into a plurality of chokes; and a connecting face connecting between the top faces of some of the plurality of chokes, each of which has a latch hole formed in its inner side face.

The connecting face may be flush with the top faces and connect therebetween.

The top face may protrude more than the inner side face in the longitudinal direction of the choke seal structure.

The length of the top faces connected by the connecting face may be equal to the length of the inner side face in the longitudinal direction of the choke seal structure.

In accordance with another aspect of the present disclosure, a structure for shielding electromagnetic waves comprises: a choke seal structure having a bottom face extended from a side wall portion formed at a periphery of a door in a plane direction defined by the door, an inner side face extended from the bottom face in a thickness direction of the door, and a top face extended from the inner side face toward side wall portion, the choke seal structure having a length extending along the periphery of the door; and a plurality of slots arranged in a longitudinal direction of the choke seal structure at a predetermined spacing and partitioning the choke seal structure into a plurality of chokes, wherein the chokes are divided into a first choke having a latch hole formed in the inner side face and a second choke having no latch hole formed therein, and wherein a length of the top face of the first choke is larger than a length of the top face of the second choke.

The top face may protrude more than the inner side face in the longitudinal direction of the choke seal structure.

The length of the top face of the first choke may be equal to the length of the inner side face in the longitudinal direction of the choke seal structure.

In accordance with another aspect of the present disclosure, a door includes: a door panel forming a frame of the door; and a structure disposed at the door panel and for shielding electromagnetic waves, wherein the structure for shielding electromagnetic waves comprises: a choke seal structure having a bottom face extended from a side wall portion formed at a periphery of a door in a plane direction defined by the door, an inner side face extended from the bottom face in a thickness direction of the door, and a top face extended from the inner side face toward side wall portion, the choke seal structure having a length extending along the periphery of the door; a plurality of slots arranged in a longitudinal direction of the choke seal structure at a predetermined spacing and partitioning the choke seal structure into a plurality of chokes; and a connecting face connecting between the top faces of some of the plurality of chokes, each of which has a latch hole formed in its inner side face.

In accordance with another aspect of the present disclosure, a cooking appliance includes: a main body having a cooking chamber therein and an open front face; a door connected to the front face of the main body to open or close the cooking chamber; and a latch mechanism installed at the door to fasten or release the door to/from the main body, wherein the door comprises a door panel forming a frame of the door; and a latch hole formed by penetrating a structure for shielding electromagnetic waves and passes therethrough at least a part of the latch mechanism installed in the door, wherein the structure for shielding electromagnetic waves comprises: a choke seal structure having a bottom face extended from a side wall portion formed at a periphery of a door in a plane direction defined by the door, an inner side face extended from the bottom face in a thickness direction of the door, and a top face extended from the inner side face toward side wall portion, the choke seal structure having a length extending along the periphery of the door; a plurality of slots arranged in a longitudinal direction of the choke seal structure at a predetermined spacing and partitioning the choke seal structure into a plurality of chokes; and a connecting face connecting between the top faces of some of the plurality of chokes, each of which has a latch hole formed in its inner side face.

The inner side surface may form an inductance component, the top face may form a capacitance component, and the connecting face may increase the capacitance component formed by the top face.

According to the structure for shielding electromagnetic waves according to the exemplary embodiment of the present disclosure, a door and a cooking appliance therewith, the top faces of the chokes having the latch hole formed are connected by the connecting face to thereby increase the overall length of the top face, such that the capacitance C components are increased as much as the inductance L components are decreased, thereby maintaining the resonance frequency f0. Therefore, it is possible to provide stable electromagnetic wave shielding performance even if the latch hole is formed in the choke seal structure.

According to the structure for shielding electromagnetic waves according to the exemplary embodiment of the present disclosure, a door and cooking appliance therewith, a large latch hole is allowed to be formed, so that the inductance L component of the choke can be reduced, and the overall length of the top face can be increased accordingly. Therefore, it is possible to provide a stable electromagnetic wave shielding performance while increasing the size of the latch hole to thereby reducing the degree of difficulty of the latch installation work and reducing the time required.

DETAILED DESCRIPTION

Figure 1:
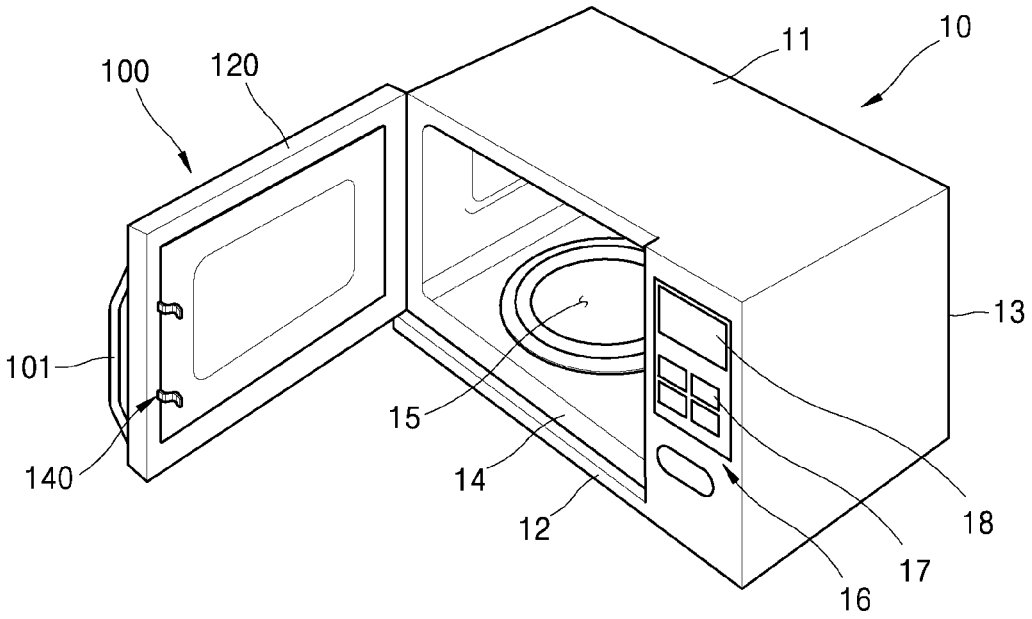
FIG. 1 is a perspective view of a cooking appliance according to a first exemplary embodiment of the present disclosure.

Hereinafter, embodiments of a structure for shielding electromagnetic waves according to an exemplary embodiment of the present disclosure, a door including it, and a cooking appliance therewith will be described with reference to the accompanying drawings. In the drawings, the thickness of lines or the size of the elements may be exaggerated and not drawn on scale for the purposes of clarity and convenience. In the following description, the terms or words used in the specification and claims shall not be construed merely in a conventional and dictionary definition but shall be construed in a meaning and concept corresponding to the technical idea of the present disclosure based on the principle that an inventor is allowed to properly define the concepts of terms in order to describe his or her invention in the best way. Therefore, the definition of such terminologies should be construed based on the contents throughout the specification.

[Overall Structure of Cooking Appliance]

FIG. 1 is a perspective view of a cooking appliance according to a first exemplary embodiment of the present disclosure.

Referring to FIG. 1, an exterior of the cooking appliance according to an exemplary embodiment of the present disclosure is formed by a main body 10. The main body 10 may have a generally box shape and is formed of a material having a predetermined strength to protect a plurality of parts disposed therein.

The main body 10 may include a frame 11 forming left and right side faces and an upper face of the main body 10, a base 12 disposed at the lower portion of the frame 11 to form the bottom of the main body 10, a rear plate 13 disposed at the rear of the frame 11 to form the rear face of the main body 10, and a front plate 14 disposed at the front of the frame 11 to form the front face of the main body 10. In the front plate 14, an open area for opening a cooking chamber 15 forward is formed.

In the main body 10, a cooking chamber 15 is formed. The cooking chamber 15 is in a box shape its front face opened. By heating the inner space of the cooking chamber 15 while the cooking chamber 15 is shielded, food is cooked. That is, in the cooking appliance, food is actually cooked inside the cooking chamber 15.

At the front of the main body 10, the door 100 for opening or closing the cooking chamber 15 is pivotably provided. The door 100 can open or close the cooking chamber 15 as a side-swinging door that pivots in the lateral direction on one side thereof.

The door 100 has a generally box shape having a predetermined thickness. On the front face of the door 100, a handle 101 is attached in order for a user to grasp it to pivot the door 100. The user can easily pivot the door 100 by the handle 101.

In addition, a control panel 16 is provided on the front face of the main body 10. The control panel 16 may have a box shape having a predetermined internal space. An input unit 17 is provided on the front face of the control panel 16 to input user's operation signals for operating a cooking appliance.

The input unit 17 is provided with a plurality of operation switches. A user can directly input operation signals by using the switches.

The control panel 16 may further include a display unit 18 for providing operation information of the door and the cooking appliance having the door and cooking information of food. The user can see various information on the cooking appliance via the display unit 18.

In addition, a heat source for heating the cooking chamber 15 is provided in the main body 10. More than one heat sources may be implemented.

In this exemplary embodiment, the heat source includes a magnetron capable of supplying a high-frequency waves into the cooking chamber 15. The magnetron may be installed inside the main body 10, and may be installed above the cooking chamber 15.

In addition, an electric field chamber may be formed in the main body 10 above or on a side of the cooking chamber 15. Electrical components such as a magnetron and a high-voltage transformer are installed inside the electric field chamber.

In addition, the cooking appliance may further include a latch mechanism 140. In this exemplary embodiment, the latch mechanism 140 is installed at the door 100. The latch mechanism 140 installed at the door 100 may pass through a latch slot formed in the front face of the main body 10 to be inserted into the main body 10 when the door 100 shields the cooking chamber 15. In this manner, the latch mechanism 140 inserted into the main body 10 can fix the door 100 to the main body 10 by engaging with a latch lever disposed in the main body 10.

The pivot movement of the door 100 relative to the main body 10 is inhibited by the latch mechanism 140, so that the cooking chamber 15 can be substantially shielded by the door 100. It is possible to sense whether the door 100 is closed or not by detecting whether the latch mechanism 140 is engaged with the latch lever. By doing so, the cooking appliance can be controlled so that it does not cook food while the door 100 is open.

[Structure of Door]

Figure 2:
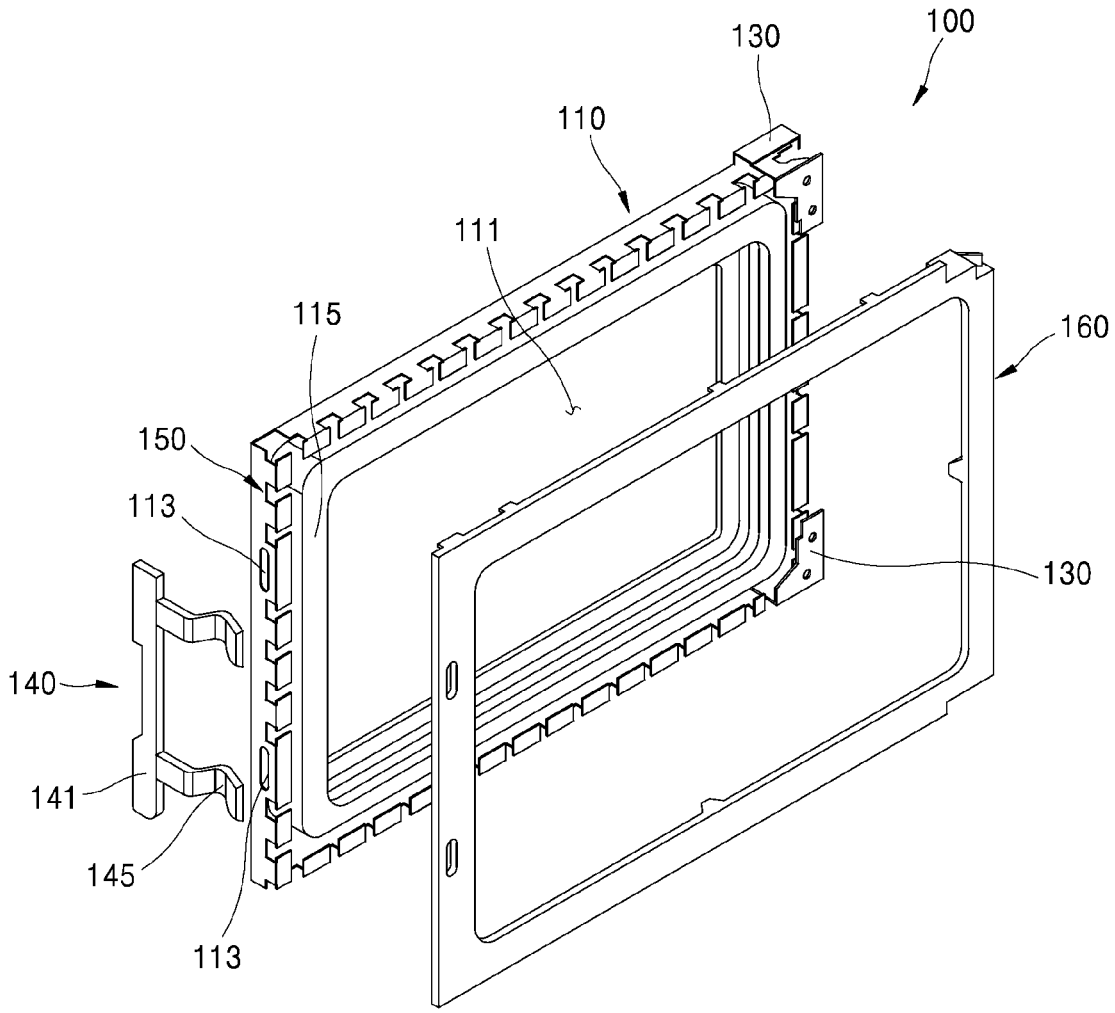
FIG. 2 is an exploded perspective view of the door shown in FIG. 1.

FIG. 2 is an exploded perspective view of the door shown in FIG. 1.

Referring to FIGS. 1 and 2, the door 100 includes a door panel 110, a choke cover 160, and a structure for shielding electromagnetic waves.

The door panel 110 forms the frame of the door 100 and may be formed in a box shape conforming to the shape of the front face of the main body 10. On the inner side of the door panel 110, an opening window 111 may be formed through it to allow the inside of the cooking chamber 15 to be seen from the outside. In this embodiment, the door panel 110 is illustrated as being formed of a metal material having a predetermined strength.

On the outer side of the door panel 110, a door frame 120 may be installed. The door frame 120 forms the front and side faces of the door 100 and may have a box shape with an opened rear face. The door panel 110 may be accommodated in the door frame 120. The choke cover 160 to be described later is installed on the rear side of the door panel 110 accommodated in the door frame 120, thereby forming the rear face of the door 100.

A hinge member 130 for pivotally connecting the door panel 110 to the main body 10 is installed at one side of the door panel 110 in the lateral direction. The hinge member 130 is installed at each of the upper and lower ends of the side of the door panel 110. The door panel 110 may open or close the cooking chamber 15 as a side-swing door that pivots in the lateral direction on the side thereof coupled with the main body 10 by the hinge member 130.

An mounting space for mounting the latch mechanism 140 is formed in the door panel 110. Such mounting space may be formed at the end on the other side of the door panel 110, and may be formed in a concave groove shape recessed toward the inside of the door panel 110 from the front side of the door panel 110.

The latch mechanism 140 may be divided into a coupling portion 141 installed inside the door panel 110 and a hook portion 145 projecting from the door panel 110.

The coupling portion 141 is inserted into the mounting space formed as described above and in turn installed inside the door panel 110. The hook portion 145 is extended from the coupling portion 141 installed in the door panel 110 and protrudes from the door panel 100 through the door panel 100.

According to this exemplary embodiment, a latch hole 113 is formed in the door panel 110 that forms a passage for connecting the mounting space with the outside of the door panel 110. The hook portion 145 may get into the door panel 110, pass through the latch hole 113 and protrude from the door panel 110.

The latch hole 113 is formed in the other end on the side of the door panel 110. That is, the latch hole 113 forms a passage that passes through the door panel 110 in the lateral direction. The hook portion 145 penetrates through the side portion of the door panel 110 via the passage formed in the lateral direction and then extend toward the rear side of the door panel 110.

That is, the hook portion 145 extends out of the door panel 110 through the side portion of the door panel 110, and then protrudes toward the front face of the main body 10.

The hook portion 145 protruding toward the front face of the main body 10 may be inserted into the main body 10 through the latch slot formed in the front face of the main body 10 when the door 100 shields the cooking chamber 15. In this manner, the hook portion 145 inserted into the main body 10 may be engaged with the latch lever installed in the main body 10, such that the latch mechanism 140 can be engaged with the latch lever.

The latch mechanism 140 is installed in the door 100 such that it comes in contact with the front plate 14 that forms the front face of the main body 10. The latch hole 113 is formed at a position adjacent to the position where the latch mechanism 140 is located.

In addition, the structure for shielding electromagnetic waves to be described later is also formed in the door panel 110, and the structure has to be located in a region facing the front surface of the main body 10 in order to form a circuit for shielding electromagnetic waves. Accordingly, the structure has to be disposed in the region in contact with the front plate 14 that forms the front face of the main body 10, and thus the latch hole 113 has to be located in the structure or very closely to the structure.

A side wall portion 115 is formed on the inner side surface of the door panel 110. The side wall portion 115 extends along the periphery of the door panel 110 and protrudes in the thickness direction of the door panel 110 to form a side wall surrounding a choke seal structure 150 to be described below.

The structure for shielding electromagnetic waves is installed at the door panel 110 to form the structure for preventing electromagnetic waves from leaking and may include the choke seal structure 150 extended along the periphery of the door 110. The detailed description on the structure for shielding electromagnetic waves will be provided below.

The choke cover 160 is disposed between the front face 14 of the main body 10 and the door panel 110. The choke cover 160 is typically formed of a molded product and is formed as a separate piece from the door panel 110 to be installed on the inner side surface of the door panel 110. The choke cover 160 installed as described above shields the structure for shielding electromagnetic waves formed by the choke seal structure 150 and forms the rear exterior of the door 100.

[Structure for Shielding Electromagnetic Waves]

Figure 3:
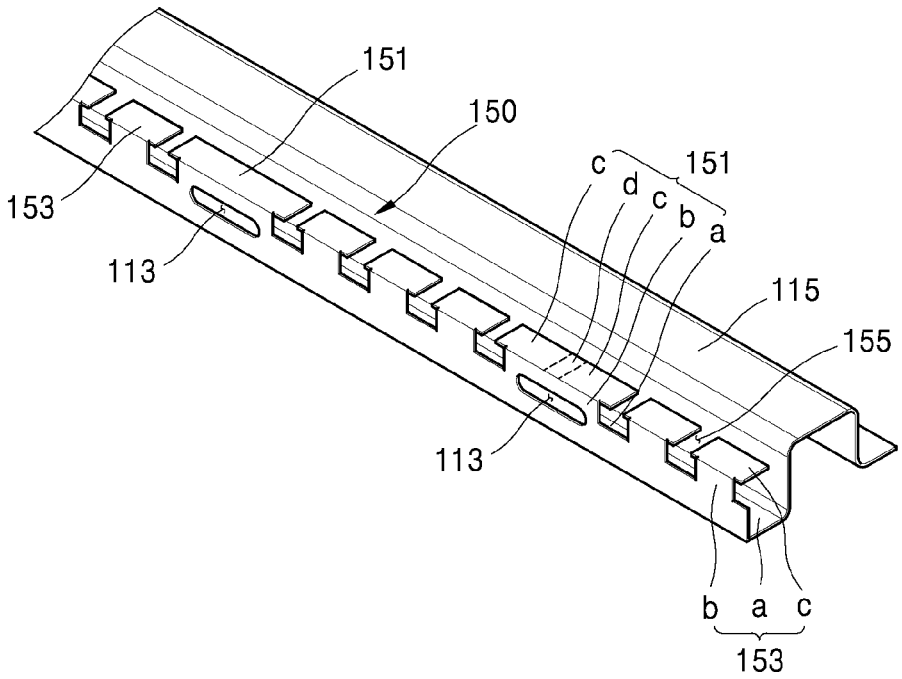
FIG. 3 is a perspective view showing the configuration of the choke seal structure shown in FIG. 2.

FIG. 3 is a perspective view showing the configuration of the choke seal structure shown in FIG. 2.

Referring to FIGS. 1 to 3, the structure for shielding electromagnetic waves forms an LC resonant circuit for preventing leakage of electromagnetic waves through a gap between the front face 14 of the main body 10 and the door 100, and may include the choke seal structure 150.

The choke seal structure 150 may have a length extending along the periphery of the door panel 110 and may have a plurality of chokes 151 and 153 and slots 155 arranged in the longitudinal direction of the choke seal structure 150.

Each of the chokes 151 and 153 is formed in such a shape that a bottom face a, an inner side face b and a top face c are connected in a "C" shape.

The bottom face a is extended in the width direction of the door panel 110 from the side wall portion 115 forming the side walls outside the choke seal structure 150.

The inner side face b is extended from the bottom face a in the thickness direction of the door panel 110, that is, in the direction that the side wall portion 115 protrudes. This inner side face b is connected to the bottom face a to form an "L" shape.

The top face c is extended from the inner side face b toward the side wall portion 115. The top face c may be connected to the inner side face b to form a "⌈" shape. In this exemplary embodiment, the top face c protrudes from the inner side face b in the longitudinal direction of the choke seal structure 150.

Each of the chokes 151 and 153 is provided such that the bottom face a, the inner side face b and the top face c are connected in a "C" shape, and a choke room is defined by them.

The choke seal structure 150 thus formed constitutes an LC resonant circuit composed of a combination of the inductance L and the capacitance C. For example, the inner side face b of each of the chokes 151 and 153 forms the inductance L component, and the top face c forms the capacitance C component.

The resonance frequency f0 determined by the inductance L and the capacitance C is represented as follows:

$$f0=1/2\pi\sqrt{LC}$$

When the frequency of an electromagnetic wave traveling toward the choke seal structure 150 is equal to the resonance frequency f0, the electromagnetic wave is filtered by the choke seal structure 150 and is blocked.

The LC resonant circuit formed by the choke seal structure 150 blocks leakage of the electromagnetic wave through the gap between the front face 14 of the main body 10 and the door 100 at the periphery of the door 100.

In the choke seal structure 150, a number of slots 155 are formed periodically. That is, a number of slots 155 are arranged at a predetermined interval in the longitudinal direction of the choke seal structure 150 so that the choke seal structure 150 is divided into a plurality of chokes 151 and 153.

Electromagnetic waves incident into the cooking chamber 15 from the magnetron are resonated in a specific mode inside the cooking chamber 15. These various modes determine the angle of incidence toward the door 100. Since it is difficult to shield electromagnetic waves having various angles of incidence with a choke having a simple structure, the choke seal structure 150 is formed with the periodic slots 155 as described above. The slots 155 are designed to effectively shield incident electromagnetic waves with random angles of incidence.

The plurality of chokes 151 and 153 partitioned by the slots 155 may be divided into first chokes 151 and second chokes 153.

In this embodiment, among the chokes 151 and 153 forming the choke seal structure 150, the first chokes 151 are defined as chokes in each of which the latch hole 113 is formed in the inner side face b. The second chokes 153 are defined as other chokes than the first chokes 151 among the chokes 151 and 153 forming the choke seal structure 150, in each of which no latch hole 113 is formed in the inner side face b.

Typically, the choke seal structure 150 is designed based on the second chokes 153. Specifically, the choke seal structure 150 is designed so that the arrangement of the chokes and the slots of the predetermined shapes satisfying the resonance frequency form a periodical repeated pattern.

However, when the latch hole 113 is formed in some of these chokes, the shape of the choke becomes uneven at the position where the latch hole 113 is formed, so that the periodic structure of the choke is broken.

Figure 4:
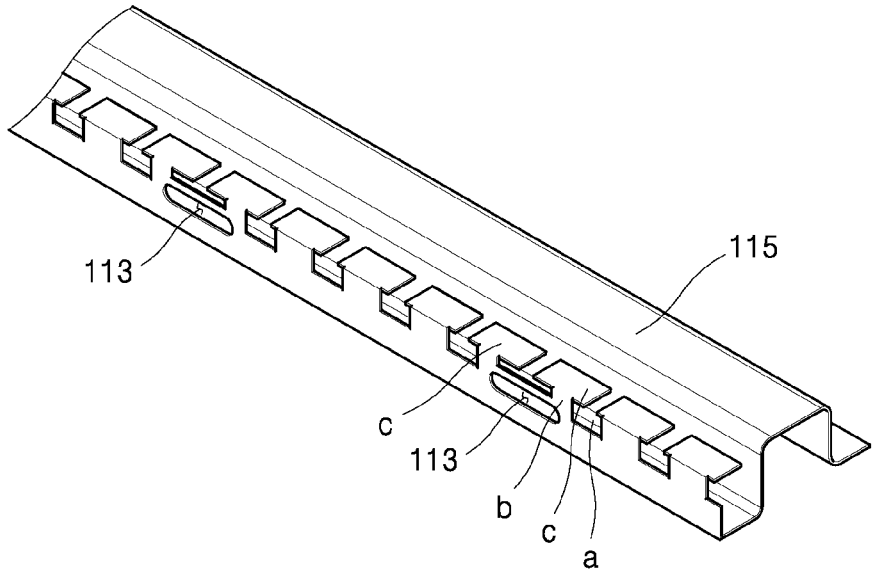
FIG. 4 is a perspective view showing a configuration of a choke part formed in a door of an existing cooking appliance.

For example, when the latch hole 113 is formed in the inner side face b of the first choke 151, the length of the inner side face b near the first choke 151 become shorter, and thus the shape of the chokes become uneven (see FIG. 4). Herein, the length of the inner side face refers to the length of the inner side face extending in the thickness direction of the door panel. In the portion where the shape becomes uneven, the inductance L component is reduced such that the frequency of the LC resonant circuit designed beforehand deviates from the resonance frequency f0. As a result, electromagnetic waves may leak in the portion that thus the performance of the choke is deteriorated.

In the light of the above according to the exemplary embodiment of the present disclosure, the structure of the first choke 151 having the latch hole 113 formed in the inner side face b is designed as described below.

Specifically, the first choke 151 is designed such that the capacitance C component is increased as much as the inductance L component is decreased in the inner side face b, such that the LC resonant circuit formed at the portion can satisfy the resonance frequency f0.

To this end, in the first choke 151, a connecting face d for connecting between two top faces c adjacent to each other in the longitudinal direction of the choke seal structure 150 is formed.

According to this exemplary embodiment, the first choke 151 consists of two chokes having the latch hole 113 formed in the inner side face b.

According to this exemplary embodiment, the connecting face d connects between two top faces c of the two chokes of the first choke 151, respectively, and is flush with the two top faces c.

The connecting face d thus formed increases the overall length of the top faces c formed on the top of the first choke 151 in the longitudinal direction of the choke seal structure 150 (hereinafter referred to as periodic direction). As a result, the length of the entire top face c formed on the top of the first choke 151 is longer than the length of the top face c of the second choke 153 in the periodic direction.

As a result, near the first choke 151, the capacitance (C) component formed by the first choke 151 is increased in proportion to the increase in length of the top face c of the first choke 151.

In other words, in order to keep the resonance frequency f0 in the first choke 151 equal to the resonance frequency f0 in the second choke 153, the capacitance (C) component is increased as much as the inductance (L) is decreased.

In general, when the inductance (L) components decrease and the capacitance (C) components increase, the frequency band is widened and thus the electromagnetic wave filtering characteristic is improved. According to this embodiment, the problem of breaking the choke period structure due to the latch hole 113 can be solved by using this principle, and the electromagnetic wave shielding characteristic according to the frequency variations can be improved.

[Operation and Effect of Structure for Shielding Electromagnetic Waves]

Figure 5:
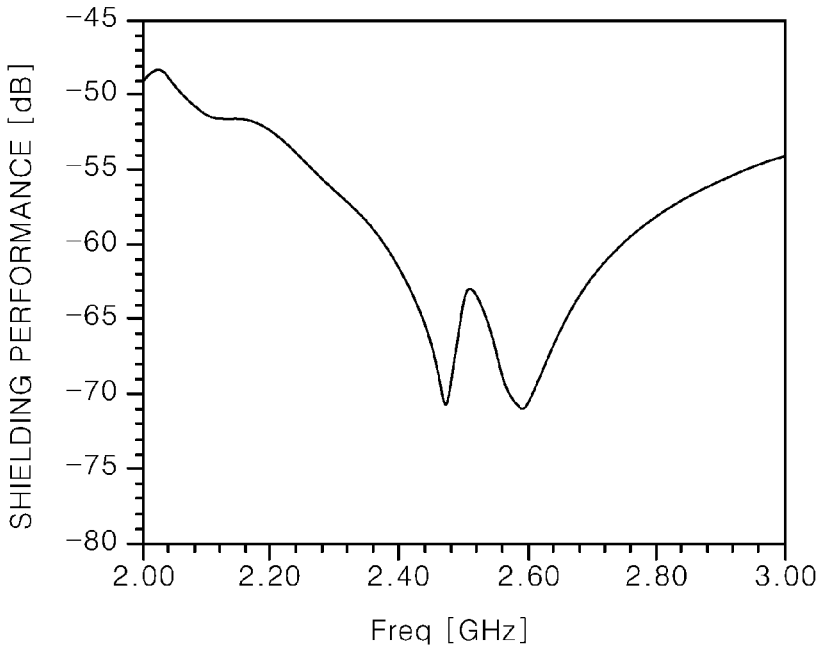
FIG. 5 is a graph showing an S-parameter measured at a door gap of an existing cooking appliance.
Figure 6:
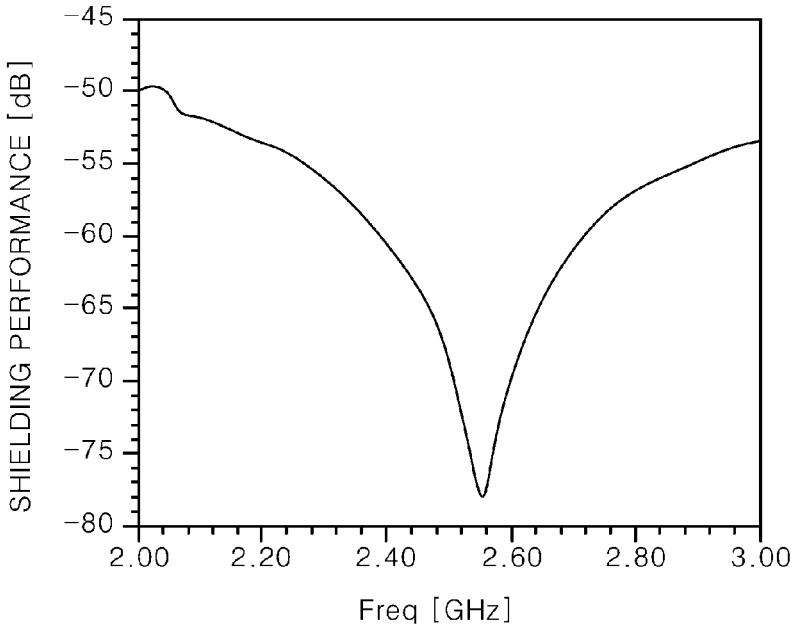
FIG. 6 is a graph showing an S-parameter measured at a door gap of the cooking appliance according to a first exemplary embodiment of the present disclosure.

FIG. 4 is a perspective view showing a configuration of a choke seal structure formed in a door of an existing cooking appliance. FIG. 5 is a graph showing an S-parameter measured at a door gap of an existing cooking appliance. FIG. 6 is a graph showing an S-parameter measured at a door gap of the cooking appliance according to a first exemplary embodiment of the present disclosure. It shows a result obtained from an experiment for measuring electromagnetic waves leaked from the door gap of the cooking appliance. In the above experiment, the experimental conditions are the same except for the configuration of the choke seal structure.

Hereinafter, the operation and effects of the structure for shielding electromagnetic waves according to the exemplary embodiment of the present disclosure will be described with reference to FIGS. 3 to 7.

Referring to FIGS. 3 and 4, a difference between the structure for shielding electromagnetic waves according to the exemplary embodiment of the present disclosure and the choke seal structure formed in the door of the existing cooking appliance lies in the connecting face d.

Specifically, in the choke seal structure formed in the door of the existing cooking appliance, the length of the inner side face b at the position where the latch hole 113 is formed (herein, the length of the inner side face refers to the length of the inner side face extending in the thickness direction of the door panel) is received and thus the shape of the choke becomes uneven. As a result, the inductance L component is reduced in the position, and the previously designed periodic structure of the LC resonant circuit is broken.

The choke seal structure provided in the cooking appliance using the high frequency supplied by the magnetron as the heat source should have a high shielding performance against electromagnetic waves having the frequency of 2.45 GHz which is the frequency of electromagnetic waves supplied by the magnetron.

However, it can be seen from the graph shown in FIG. 5 that in the choke seal structure formed in the door of the existing cooking appliance, there are the leakages of the electromagnetic waves around the frequency of 2.45 GHz.

In contrast, in the structure for shielding electromagnetic waves according to the exemplary embodiment of the present disclosure, the connecting face d is formed which increases the overall length of the top face c formed on the top of the first choke 151 in the periodic direction of the choke seal structure 150. Accordingly, near the first choke 151, the capacitance C component formed by the first choke 151 is increased in proportion to the increased length of the top face c of the first choke 151. As a result, the resonance frequency f0 of the region can be kept the same as the other regions.

It can be seen from the graph shown in FIG. 6 that the structure for shielding electromagnetic waves according to the exemplary embodiment of the present disclosure exhibits excellent shielding performance against the electromagnetic waves around the frequency of 2.45 GHz.

Figure 7:
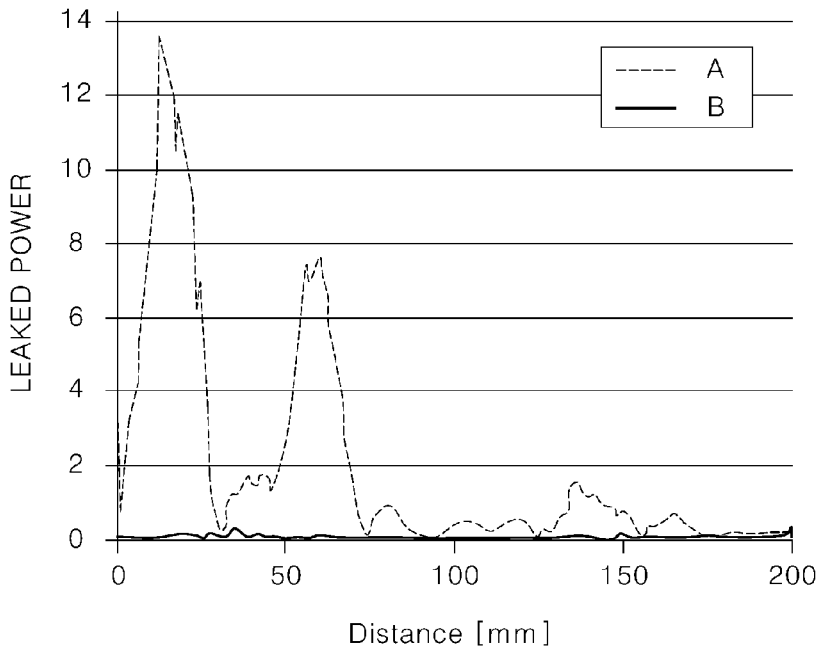
FIG. 7 is a graph showing results obtained by comparing leaked power measured at a door gap of the existing cooking appliance with that of the cooking appliance according to the first exemplary embodiment of the present disclosure.

FIG. 7 is a graph showing results obtained by comparing leaked power measured at a door gap of the existing cooking appliance with that of the cooking appliance according to the first exemplary embodiment of the present disclosure. It shows a result obtained from an experiment for measuring electromagnetic waves leaked from the door gaps of the cooking appliances.

In the above experiment, the experimental conditions are the same except for the configuration of the choke seal structure. In the graph, the positions are determined by measuring distances from the reference point in the portion where the choke seal structure is formed on the door. The latch holes are located in the range of 20 to 40 mm, and in the range of 130 to 150 mm.

Referring to FIG. 7, in the choke seal structure A formed in the door of the existing cooking appliance, a large leaked power was measured in the range of 10 to 70 mm around the latch hole. In addition, some leaked power was measured in the range of 120 to 160 mm as well, though it was smaller than that in the range of the 10 to 70 mm.

These results are attributed to the fact that the shape of the chokes became uneven at the position where the latch hole is formed, so that the periodic structure of the choke is broken and thus the leakage of the electromagnetic wave occurred at the position.

In contrast, in the structure for shielding electromagnetic waves B according to the exemplary embodiment of the present disclosure, leaked power was rarely measured throughout the all positions including the latch hole and its vicinity. As a result, it can be seen that the structure B according to the exemplary embodiment of the present disclosure exhibits very excellent electromagnetic wave shielding performance even with the latch hole formed in the choke seal structure.

According to the structure for shielding electromagnetic waves according to the exemplary embodiment of the present disclosure, a door and a cooking appliance therewith, the top faces of the chokes having the latch hole formed are connected by the connecting face to thereby increase the overall length of the top face, such that the capacitance C components are increased as much as the inductance L components are decreased, thereby maintaining the resonance frequency f0. Therefore, it is possible to provide stable electromagnetic wave shielding performance even if the latch hole is formed in the choke seal structure.

According to the structure for shielding electromagnetic waves according to the exemplary embodiment of the present disclosure, a door and cooking appliance therewith, a large latch hole is allowed to be formed, so that the inductance L component of the choke can be reduced, and the overall length of the top face can be increased accordingly. Therefore, it is possible to provide a stable electromagnetic wave shielding performance while increasing the size of the latch hole to thereby reducing the degree of difficulty of the latch installation work and reducing the time required.

[Variations of Structure for Shielding Electromagnetic Waves]

The above-described structure for shielding electromagnetic waves is merely an exemplary embodiment of the present disclosure, and variations thereof can be contemplated.

Figure 8:
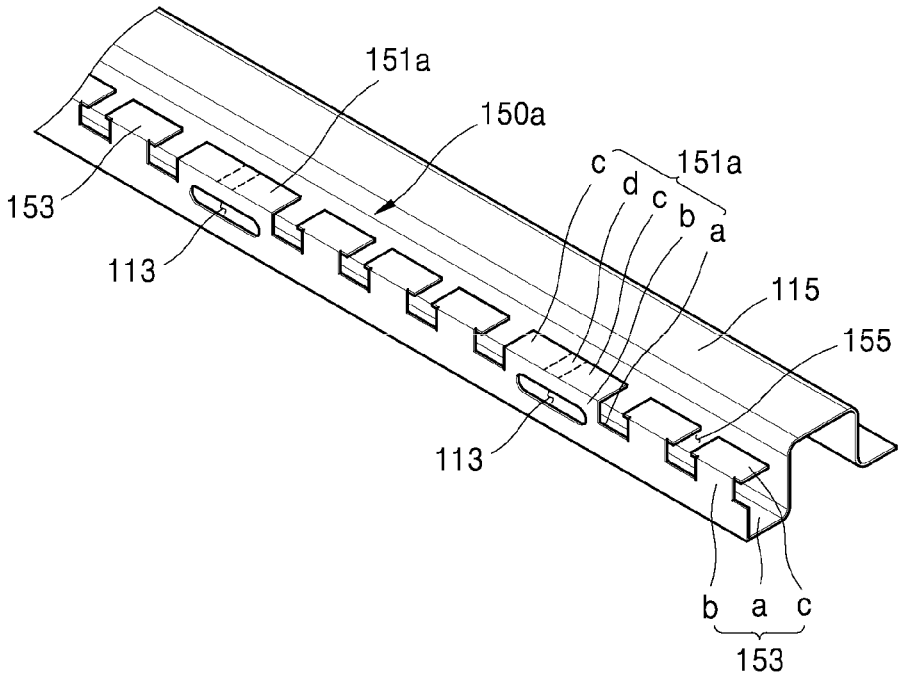
FIG. 8 is a perspective view showing the configuration of a choke seal structure according to a second exemplary embodiment of the present disclosure.
Figure 9:
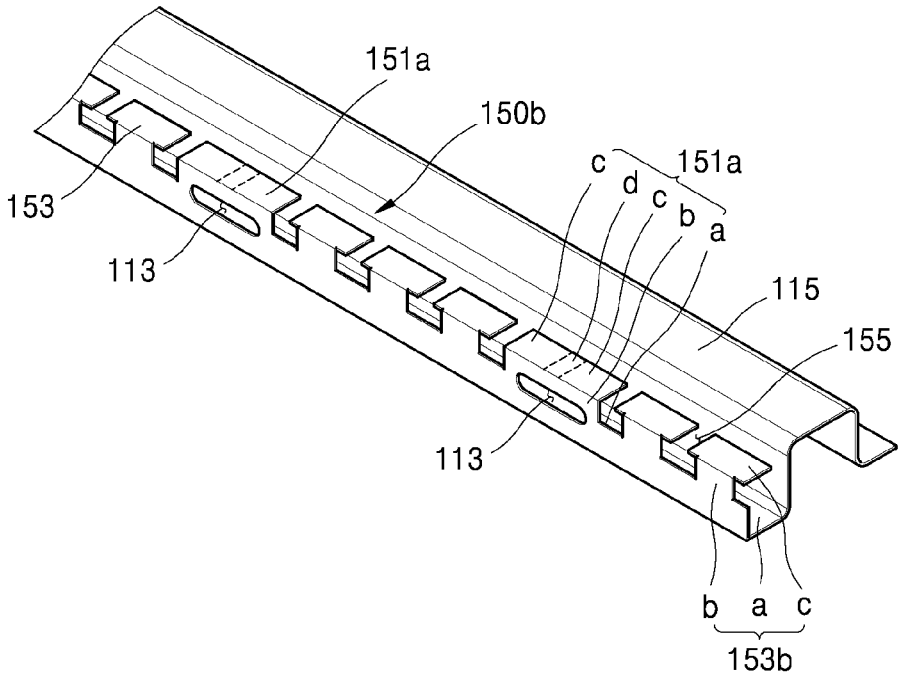
FIG. 9 is a perspective view showing the configuration of a choke seal structure according to a third exemplary embodiment of the present disclosure.

FIG. 8 is a perspective view showing the configuration of a choke seal structure according to a second exemplary embodiment of the present disclosure. FIG. 9 is a perspective view showing the configuration of a choke seal structure according to a third exemplary embodiment of the present disclosure.

Hereinafter, other exemplary embodiments of the present disclosure will be described with reference to FIGS. 8 and 9.

Like reference numerals to those used in the above drawings denote like elements, and redundant descriptions of such elements will not be repeated. It is to be noted that in the following description, "length" refers to "length in the periodic direction."

Referring to FIG. 8, a choke seal structure 150*a* according to the second exemplary embodiment is different from the choke seal structure 150 shown in FIG. 3 in that the length of a top face c of a first choke 151*a* is reduced.

According to the second exemplary embodiment, the overall length of the top face c of the first choke 151*a*, which is extended by the connecting face d, is larger than the length of the top face c of each of the second chokes 153 and is equal to the length of the inner side face b connected thereto.

By determining the shape of the first choke 151*a* as described above, it is possible to avoid that the capacitance C components formed by the top face c and the connecting face d in the first choke 151*a* is increased too much. Thus, the choke seal structure can be designed more efficiently for maintaining the resonance frequency f0 around the first choke 151*a*.

Referring to FIG. 9, a choke seal structure 150*b* according to the third exemplary embodiment of the present disclosure has the shape of the first choke 151*a* according to the second embodiment, and the periodic structure of the entire choke including the first choke 151*a* and the second choke 153*b* are rearranged.

In the choke seal structure 150*a* according to the second exemplary embodiment shown in FIG. 8, as the length of the top face c of the first choke 151 is reduced, such that the distance between the first choke 151*a* (see FIG. 8) and the second choke 153 is increased. In view of this, according to the third embodiment, the chokes are relocated so that the distance between the first choke 151*a* and the second choke 153 is kept constant. As a result, the choke can be designed more efficiently for providing stable electromagnetic wave shielding performance.

Although the exemplary embodiments of the present disclosure have been described with reference to the accompanying drawings, these are merely illustrative. It will be appreciated by those skilled in the art that various modifications and equivalents are possible without departing from the scope of the present disclosure. Accordingly, the true scope sought to be protected is defined solely by the claims.

What is claimed is:

1. A structure for shielding electromagnetic waves, comprising:

a choke seal structure having a bottom face extended from a side wall portion formed at a periphery of a door in a plane direction defined by the door, an inner side face extended from the bottom face in a thickness direction of the door, and a top face extended from the inner side face toward side wall portion, the choke seal structure having a length extending along the periphery of the door; and a plurality of slots arranged in a longitudinal direction of the choke seal structure at a predetermined spacing other than where a connecting face is disposed in place of the slot, and partitioning the choke seal structure into a plurality of chokes, wherein each of the choke has the inner side face and the top face, wherein the chokes are divided into a first choke having a latch hole formed in the inner side face and a second choke having no latch hole formed therein, in the first choke, the connecting face is disposed between the top faces in place of the slot between the top faces, and a total length of the top faces and the connecting face of the first choke is longer than a length of the top face of the second choke.

2. The structure of claim 1, wherein the connecting face is flush with the top faces and connects therebetween.

3. The structure of claim 1, wherein the top face protrudes more than the inner side face in the longitudinal direction of the choke seal structure in a slot.

4. The structure of claim 1, wherein a length of the top faces connected by the connecting face is equal to the length of the inner side face in the longitudinal direction of the choke seal structure.

5. The structure of claim 1, wherein the top face protrudes more than the inner side face in the longitudinal direction of the choke seal structure in a slot.

6. The structure of claim 1, wherein a length of the top face of the first choke is equal to the length of the inner side face in the longitudinal direction of the choke seal structure.

7. The structure of claim 6, wherein a distance between the first choke and the second choke, and a distance between the second choke and another adjacent second choke, are equal.

8. A door comprising:

a door panel forming a frame of the door; and a structure disposed at the door panel for shielding electromagnetic waves, wherein the structure for shielding electromagnetic waves comprises:

a choke seal structure having a bottom face extended from a side wall portion formed at a periphery of a door in a plane direction defined by the door, an inner side face extended from the bottom face in a thickness direction of the door, and a top face extended from the inner side face toward side wall portion, the choke seal structure having a length extending along the periphery of the door; and a plurality of slots arranged in a longitudinal direction of the choke seal structure and partitioning the choke seal structure into a plurality of chokes, wherein each of the choke has the inner side face and the top face, wherein the chokes are divided into a first choke having a latch hole formed in the inner side face and a second choke having no latch hole formed therein, and wherein a length of the top face of the first choke is longer than a length of the top face of the second choke.

9. The door of claim 8, wherein the top face of the first choke comprises: a connecting face connecting between top faces of some of the plurality of chokes.

10. The structure of claim 8, wherein the top face protrudes more than the inner side face in the longitudinal direction of the choke seal structure in a slot.

11. The structure of claim 8, wherein a length of the top face of the first choke is equal to the length of the inner side face in the longitudinal direction of the choke seal structure.

12. The structure of claim 11, wherein a distance between the first choke and the second choke, and a distance between the second choke and another adjacent second choke, are equal.

13. A cooking appliance comprising:

a main body having a cooking chamber therein and an open front face;

a door pivotally connected to the front face of the main body to open or close the cooking chamber; and a latch mechanism installed at the door to fasten or release the door to/from the main body, wherein the door comprises a door panel forming a frame of the door;

a structure disposed at the door panel for shielding electromagnetic waves; and a latch hole formed by penetrating the structure for shielding electromagnetic waves, wherein at least a part of the latch mechanism installed in the door passes therethrough, wherein the structure for shielding electromagnetic waves comprises:

a choke seal structure having a bottom face extended from a side wall portion formed at a periphery of a door in a plane direction defined by the door, an inner side face extended from the bottom face in a thickness direction of the door, and a top face extended from the inner side face toward side wall portion, the choke seal structure having a length extending along the periphery of the door; and a plurality of slots arranged in a longitudinal direction of the choke seal structure at a predetermined spacing other than where a connecting face is disposed in place of the slot, and partitioning the choke seal structure into a plurality of chokes, wherein each of the choke has the inner side face and the top face, wherein the chokes are divided into a first choke having a latch hole formed in the inner side face and a second choke having no latch hole formed therein, in the first choke, the connecting face is disposed between the top faces in place of the slot between the top faces, and a total length of the top faces and the connecting face of the first choke is longer than a length of the top face of the second choke.

14. The cooking appliance of claim 13, wherein the inner side surface forms an inductance component, the top face forms a capacitance component, and the connecting face increases the capacitance component formed by the top face.

15. The structure of claim 13, wherein the top face protrudes more than the inner side face in the longitudinal direction of the choke seal structure in a slot.

16. The structure of claim 13, wherein a length of the top faces connected by the connecting face is equal to the length of the inner side face in the longitudinal direction of the choke seal structure.

* * * * *